US009611120B2

(12) United States Patent
Suzuki

(10) Patent No.: US 9,611,120 B2
(45) Date of Patent: Apr. 4, 2017

(54) SHEET DISCHARGE APPARATUS PROVIDED WITH A PLURALITY OF SHEET DISCHARGE TRAYS

(71) Applicant: Brother Kogyo Kabushiki Kaisha, Nagoya-shi, Aichi-ken (JP)

(72) Inventor: Yasuhiro Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/049,201

(22) Filed: Feb. 22, 2016

(65) Prior Publication Data

US 2016/0257518 A1 Sep. 8, 2016

(30) Foreign Application Priority Data

Mar. 5, 2015 (JP) ..... 2015-043681

(51) Int. Cl.

| | |
|---|---|
| ***B65H 29/00*** | (2006.01) |
| ***B65H 31/24*** | (2006.01) |
| ***B65H 31/02*** | (2006.01) |
| ***B65H 31/22*** | (2006.01) |
| ***B65H 43/00*** | (2006.01) |

(52) U.S. Cl.

CPC ..... *B65H 31/24* (2013.01); *B65H 31/02* (2013.01); *B65H 31/22* (2013.01); *B65H 43/00* (2013.01); *B65H 2301/421* (2013.01); *B65H 2301/4212* (2013.01); *B65H 2403/481* (2013.01); *B65H 2403/722* (2013.01); *B65H 2403/724* (2013.01); *B65H 2405/332* (2013.01); *B65H 2408/111* (2013.01); *B65H 2513/412* (2013.01);

(Continued)

(58) Field of Classification Search

CPC ... B65H 31/22; B65H 31/24; B65H 2405/332

See application file for complete search history.

(56) References Cited

U.S. PATENT DOCUMENTS

| | | | |
|---|---|---|---|
| 6,295,081 | B1 | 9/2001 | Kashima et al. |
| 6,308,952 | B1 | 10/2001 | Takagi et al. |

(Continued)

FOREIGN PATENT DOCUMENTS

| | | | |
|---|---|---|---|
| JP | H11-228013 | A | 8/1999 |
| JP | H11-228015 | A | 8/1999 |

(Continued)

*Primary Examiner* — Howard Sanders

(74) *Attorney, Agent, or Firm* — Banner & Witcoff, Ltd.

(57) ABSTRACT

A sheet discharge apparatus includes first and second discharge trays, a support unit, first and second discharge rollers, and first and second controlling units. The second discharge tray is disposed above the first discharge tray and is detachable from the support unit. The first and second discharge rollers discharge a sheet toward the first and second discharge trays respectively. The first controlling unit executes control such that, in a case that the second discharge tray is detached from the support unit while the first discharge roller and the second discharge roller are halted, the first discharge roller remains halted, and in a case that the second discharge tray is detached from the support unit while the first discharge roller and the second discharge roller are rotating, the first discharge roller is halted after the first discharge roller continues rotating until a sheet has been discharged toward the first discharge tray.

7 Claims, 12 Drawing Sheets

(52) U.S. Cl.
CPC .... *B65H 2601/521* (2013.01); *B65H 2801/03* (2013.01); *B65H 2801/06* (2013.01)

(56) References Cited

U.S. PATENT DOCUMENTS

| | | | | |
|---|---|---|---|---|
| 6,331,003 | B1 | 12/2001 | Yokota et al. | |
| 6,443,449 | B1 | 9/2002 | Takagi et al. | |
| 6,515,735 | B2 | 2/2003 | Takoh | |
| 2002/0118351 | A1 | 8/2002 | Takoh | |
| 2015/0021847 | A1* | 1/2015 | Hori ..... | B65H 1/28 271/9.02 |

FOREIGN PATENT DOCUMENTS

| | | | |
|---|---|---|---|
| JP | 2002-249273 | A | 9/2002 |
| JP | 2009-126598 | A | 6/2009 |
| WO | 01-34508 | A1 | 5/2001 |

* cited by examiner

SHEET DISCHARGE APPARATUS PROVIDED WITH A PLURALITY OF SHEET DISCHARGE TRAYS

CROSS REFERENCE TO RELATED APPLICATION

This application claims priority from Japanese Patent Application No. 2015-043681 filed Mar. 5, 2015. The entire content of the priority application is incorporated herein by reference.

TECHNICAL FIELD

The present disclosure relates to a sheet discharge apparatus for discharging a sheet.

BACKGROUND

Japanese Patent Application publication No. H11-228013 discloses a sheet discharge apparatus in Which a plurality of discharge trays is arrayed in vertical direction and the plurality of trays is detachably attached to a support portion such as a housing. The sheet discharge apparatus performs a "discharge mode" (hereinafter simply referred to as a "stacker mode") in which, assuming that an upper discharge tray has been removed from a support member whereas a lower discharge tray remains attached to the support member with respect to two vertically arrayed neighboring discharge trays, sheets are successively stacked on the lower discharge tray when the sheets are discharged from a sheet discharge portion in association with the detached upper discharge tray.

Therefore, larger volume of sheets can be stacked on the lower discharge tray in the stacker mode in comparison with a case where sheets are discharged from a sheet discharge portion in association with the lower discharge tray.

SUMMARY

In the stacker mode, sheets are discharged through an upper discharge opening, and are stacked on the lower discharge tray. Thus, in the stacker mode, rotation of a discharge roller for discharging a sheet to the lower discharge tray is not necessary. However, according the sheet discharge device disclosed in JP H11-228013, all discharge rollers are rotated even during stacker mode. Thus, it would be difficult to reduce noise generated by such all rotation.

It is therefore an object of the present disclosure to provide a sheet discharge apparatus capable of reducing noise generated during stacker mode.

In order to attain the above and other objects, the disclosure provides a sheet discharge apparatus including a first discharge tray, a second discharge tray, a support unit, an electric motor, a first discharge roller, a second discharge roller, a first controlling unit, and a second controlling unit. The second discharge tray is disposed above the first discharging tray. The support unit is configured to support the first discharge tray and the second discharge tray. The second discharge tray is attachable to and detachable from the support unit. The electric motor is configured to generate a drive force. The first discharge roller is configured to be driven by the drive force and is configured to discharge a sheet toward the first discharge tray. The second discharge roller is configured to be driven by the drive force and is configured to discharge a sheet toward the second discharge tray. The first controlling unit is configured to: control, in case that the second discharge tray is detached from the support unit while the first discharge roller and the second discharge roller are halted, the first discharge roller to remain halted; and control, in case that the second discharge tray is detached from the support unit while the first discharge roller and the second discharge roller are rotating, the first discharge roller to be halted after the first discharge roller continues rotating until a sheet has been discharged toward the first discharge tray. The second controlling unit is configured to control the second discharge roller.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
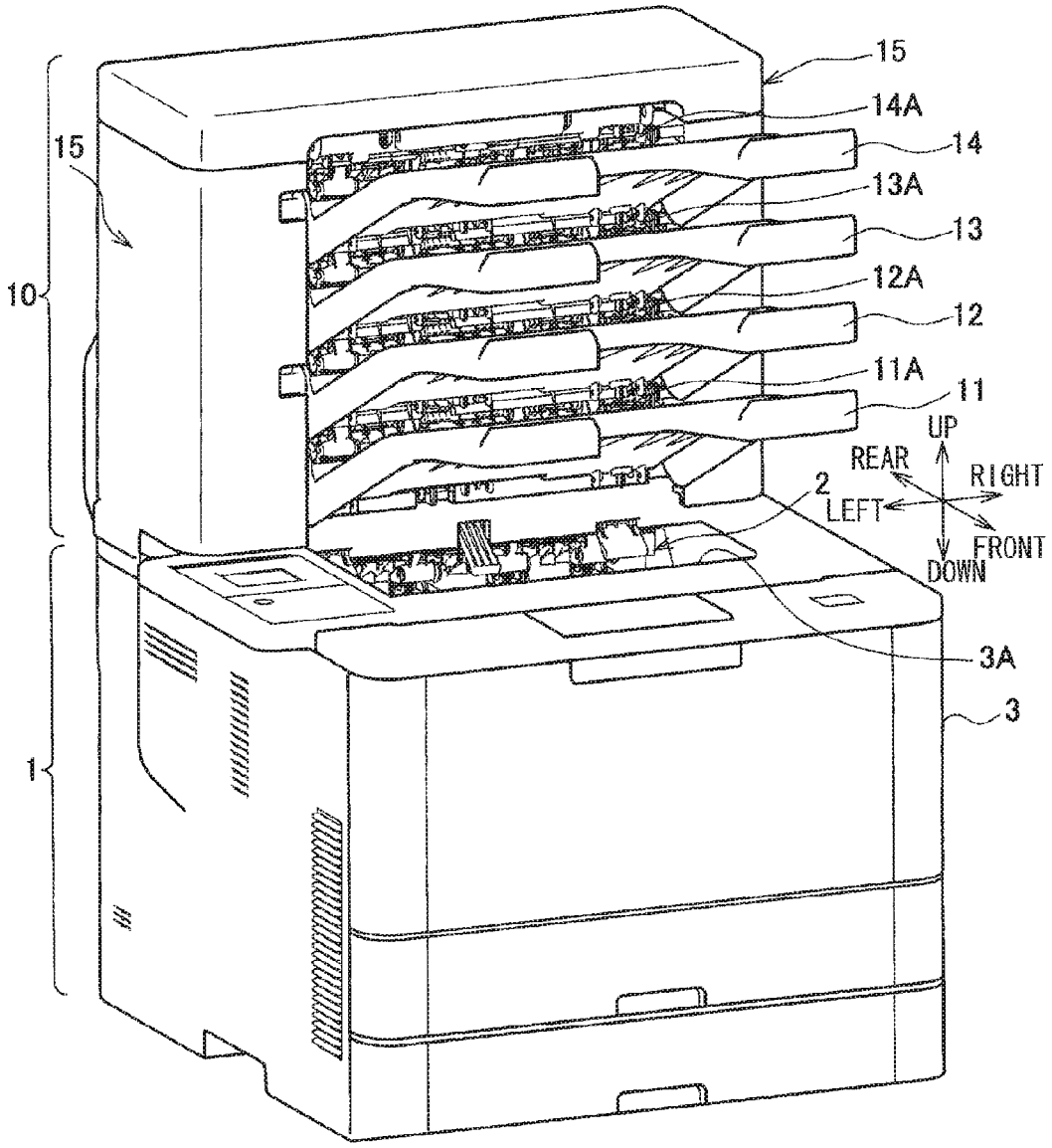
FIG. 1 is a perspective view of an image forming apparatus provided with a sheet discharge apparatus according to an embodiment.

An embodiment pertains to a sheet discharge apparatus for use in an image forming apparatus. In the following description, an image forming apparatus 1 provided with a sheet discharge apparatus 10 will be simply referred to as the "image forming apparatus".

Arrows in the drawings represent directions for better understanding to relationship between each of the drawings. The embodiment should not be recognized to limit to directions shown in each drawings. Further, each part and component described in the specification should be recognized to at least one part or component, unless otherwise described as "a plurality of" and "at least two."

1. Overall Structure of Image Forming Apparatus

As shown in FIG. 1; a sheet discharge apparatus 10 is assembled to an upper side of a discharge opening 2 of an image forming apparatus 1. An image forming unit (not shown) for forming an image on a sheet is accommodated in the image forming apparatus 1. More specifically, the image forming apparatus 1 has a housing 3 in which the image forming unit is accommodated.

The housing 3 has an upper surface forming a discharge tray 3A configured to permit sheets carrying images to be stacked thereon. Incidentally, the discharge tray 3A receives sheets when the sheet discharge apparatus 10 is not operated. Sheets are discharged to at least one of a plurality of discharge trays 11-14 described later when the sheet discharge apparatus 10 is operated.

2. Sheet Discharge Apparatus 2.1 Overview of Sheet Discharge Apparatus

As shown in FIG. 1, the sheet discharge apparatus 10 includes four discharge trays 11-14. The sheet discharge apparatus 10 discharges each sheet into one of the discharge trays 11-14 based on discharge settings preconfigured by the user.

Each of the discharge trays 11-14 is configured to receive and support one or more discharged sheets. The discharge trays 11-14 are assembled to a support unit 15 in a vertically aligned state. Sheets discharged from the image forming apparatus 1 are received on the top surfaces of the discharge trays 11-14.

In the following description, the lowest discharge tray among the vertically arranged discharge trays 11-14 will be called a first discharge tray 11; the discharge tray positioned directly above the first discharge tray 11 will be called a second discharge tray 12; the discharge tray positioned directly above the second discharge tray 12 will be called a third discharge tray 13; and the discharge tray positioned directly above the third discharge tray 13 will be called a fourth discharge tray 14.

At minimum, the second discharge tray 12 and fourth discharge tray 14 are detachably mounted on the support unit 15. In other words, the second discharge tray 12 and fourth discharge tray 14 are attachable to and detachable from the support unit 15. That is, the user is able to mount the second discharge tray 12 and fourth discharge tray 14 on and remove the same from the support unit 15.

Figure 2:
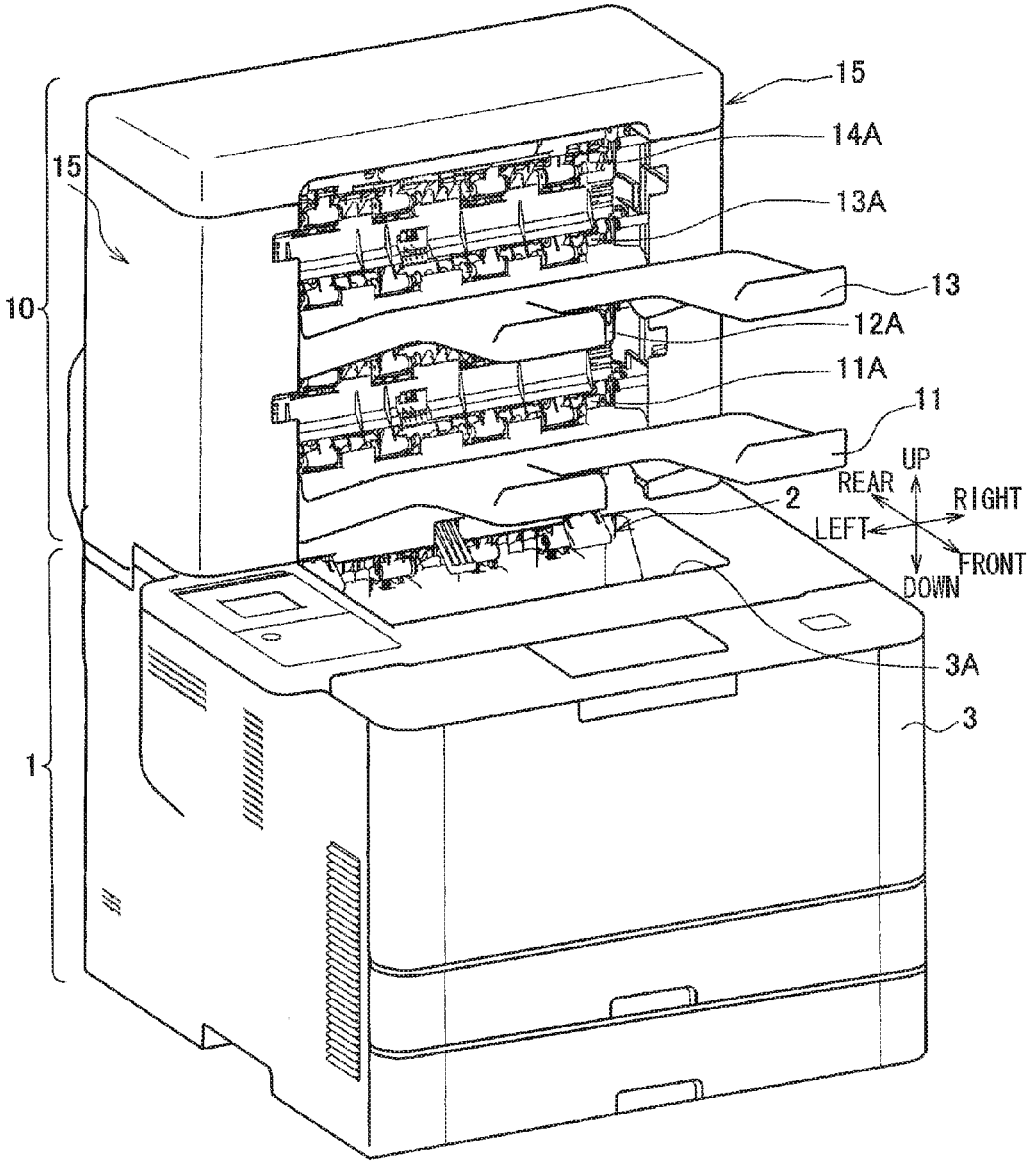
FIG. 2 is a perspective view of the image forming apparatus provided with the sheet discharge apparatus and showing a state of stacker mode according to the embodiment.

In the embodiment, the first discharge tray 11 and third discharge tray 13 are configured to be less easy to remove than the second discharge tray 12 and fourth discharge tray 14. Note that FIG. 2 shows the state of the sheet discharge apparatus 10 when the second discharge tray 12 and fourth discharge tray 14 have been removed from the support unit 15. This state of the sheet discharge apparatus 10 will be called the "stacker mode" in the following description.

The support unit 15 is provided with four discharge nits 11A-14A for discharging sheets exiting the image-forming unit (i.e., sheets on which images have been formed) into the corresponding discharge trays 11-14. The discharge units 11A-14A are aligned vertically at positions corresponding to the discharge trays 11-14.

The discharge unit 11A (hereinafter called the first discharge unit 11A) has an opening that opens into the space above the top surface of the first discharge tray 11; the discharge unit 12A (hereinafter called the second discharge unit 12A) has an opening that opens into the space above the top surface of the second discharge tray 12; the discharge unit 13A (hereinafter called the third discharge unit 13A) has an opening that opens into the space above the top surface of the third discharge tray 13; and the discharge unit 14A (hereinafter called the fourth discharge unit 14A) has an opening that opens into the space above the top surface of the fourth discharge tray 14.

Figure 3:
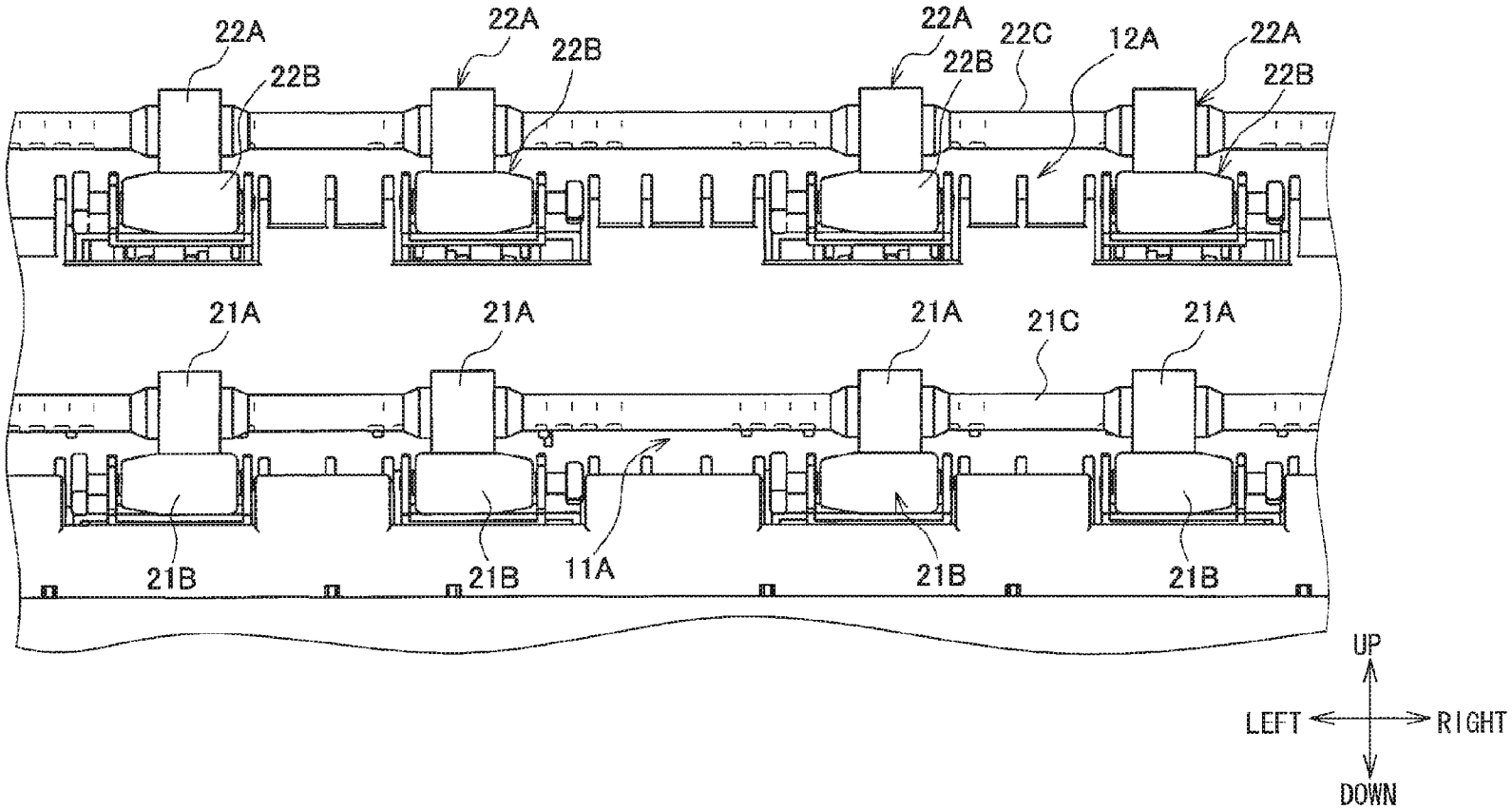
FIG. 3 is a front view showing first upper rollers, first lower rollers, second upper rollers and second lower rollers in the sheet discharge apparatus according to the embodiment.

As shown in FIG. 3, the first discharge unit 11A is provided with at least one upper roller 21A and at least one lower roller 21B for discharging a sheet toward the first discharge tray 11. The second discharge unit 12A is also provided with at least one upper roller 22A, and at least one lower roller 22B for discharging a sheet toward the second discharge tray 12. The third discharge unit 13A and fourth discharge unit 14A (FIG. 2) are each similarly provided with upper rollers and lower rollers.

2.2 Upper Rollers and Lower Rollers

The upper rollers and lower rollers provided in the discharge units 11A-14A all have the same construction. Next, the structure of the upper rollers and lower rollers will be described using the upper roller 21A (hereinafter called the first upper roller 21A) and the lower roller 21B (hereinafter called the first lower roller 21B) provided in the first discharge unit 11A as examples.

As shown in FIG. 3, a plurality of first upper rollers 21A is provided in the first discharge unit 11A. Each first upper roller 21A is formed in a cylindrical or columnar shape. The first upper rollers 21A are supported on a single shaft 21C.

The first upper rollers 21A are discretely arranged on the single shaft 21C at intervals along the longitudinal direction (hereinafter called the "width direction") of the single shaft 21C such that their axes are aligned with the width direction. The single shaft 21C transmits a rotational force to the first upper rollers 21A. The regions on the circumferential surface of the first upper rollers 21A that contact the sheets are formed of a rubber or other material having a high coefficient of friction.

The first discharge unit 11A is provided with the same number of first lower rollers 21B as first upper rollers 21A. The first lower rollers 21B are arranged beneath the corresponding first upper rollers 21A and work together with the first upper rollers 21A to grip sheets.

More specifically, the first lower rollers 21B are configured to he vertically displaceable in order to contact and separate from the corresponding first upper rollers 21A. Springs or other urging members (not shown) are provided to press the first lower rollers 21B against the corresponding first upper rollers 21A. Consequently, each first lower roller 21B presses a sheet against the corresponding first upper roller 21A.

The upper rollers 22A of the second discharge unit 12A (hereinafter called the second upper rollers 22A) are similarly arranged on a shaft 22C so as to be offset vertically relative to the first upper rollers 21A and single shaft 21C, The lower rollers 22B of the second discharge unit 12A (hereinafter called second lower rollers 22B) are offset vertically relative to the first lower rollers 21B.

In other words, if the first upper rollers 21A and single shaft 21C were to be moved upward, they would overlap the second upper rollers 22A and shaft 22C at least in the front-rear direction.

Similarly, if the first lower rollers 21B were to be moved upward, they would overlap the second lower rollers 22B at least in the front-rear direction. Note that the front-rear direction is approximately aligned with the direction of sheet discharge.

Figure 4:
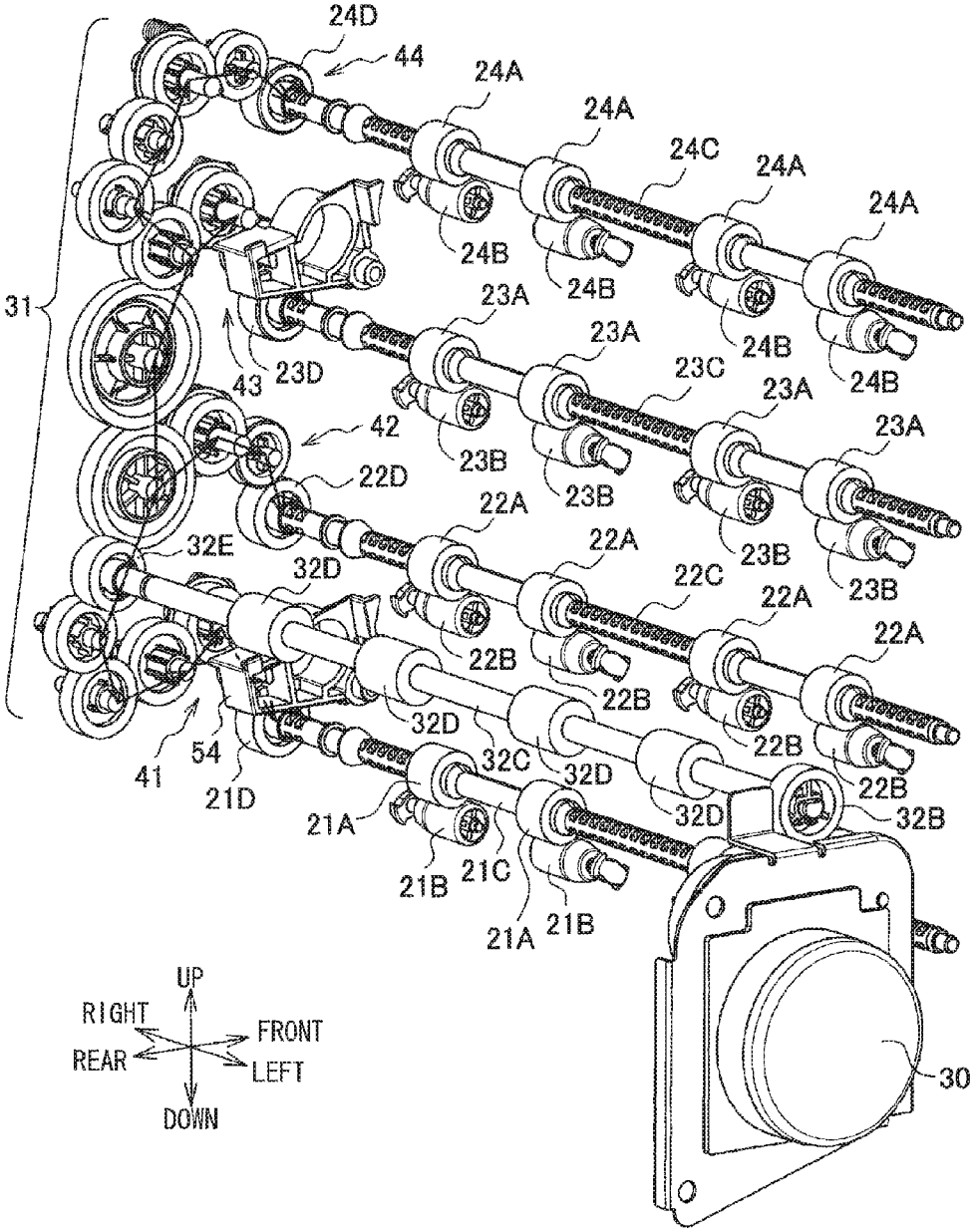
FIG. 4 is a perspective view of a power transmission mechanism for transmitting driving force to the first upper rollers and the second upper rollers in the sheet discharge apparatus according to the embodiment.

As shown in FIG. 4, the third discharge unit 13A and fourth discharge unit 14A are also provided with respective upper rollers 23A and 24A having the same arrangements and relationships as the first upper rollers 21A and second upper rollers 22A and being provided on respective shafts 23C and 24C.

Similarly, the third discharge unit 13A and fourth discharge unit 14A are provided with respective lower rollers 23B and 24B having the same arrangements and relationships as the first lower rollers 21B and second lower rollers 22B, In the following description, the first upper rollers 21A, second upper rollers 22A, third upper rollers 23A, and fourth upper rollers 24A may be collectively referred to as the "first upper rollers 21A and the like."

3. Operational Control of Upper Rollers and Lower Rollers 3.1 Provision of Drive Force As shown in FIG. 4, the sheet discharge apparatus 10 is provided with a single electric motor 30 configured to generate a drive force to drive the first upper rollers 21A and the like. The drive force generated by the electric motor 30 is provided to the first upper rollers 21A and the like via a gear mechanism 31 and the like.

More specifically, the electric motor 30 is arranged in the support unit 15 on one lateral side of the first upper rollers 21A and the like (the left side in the embodiment). The gear mechanism 31 is provided in the support unit 15 on the other lateral side of the first upper rollers 21A and the like (the right side in the embodiment).

Figure 5:
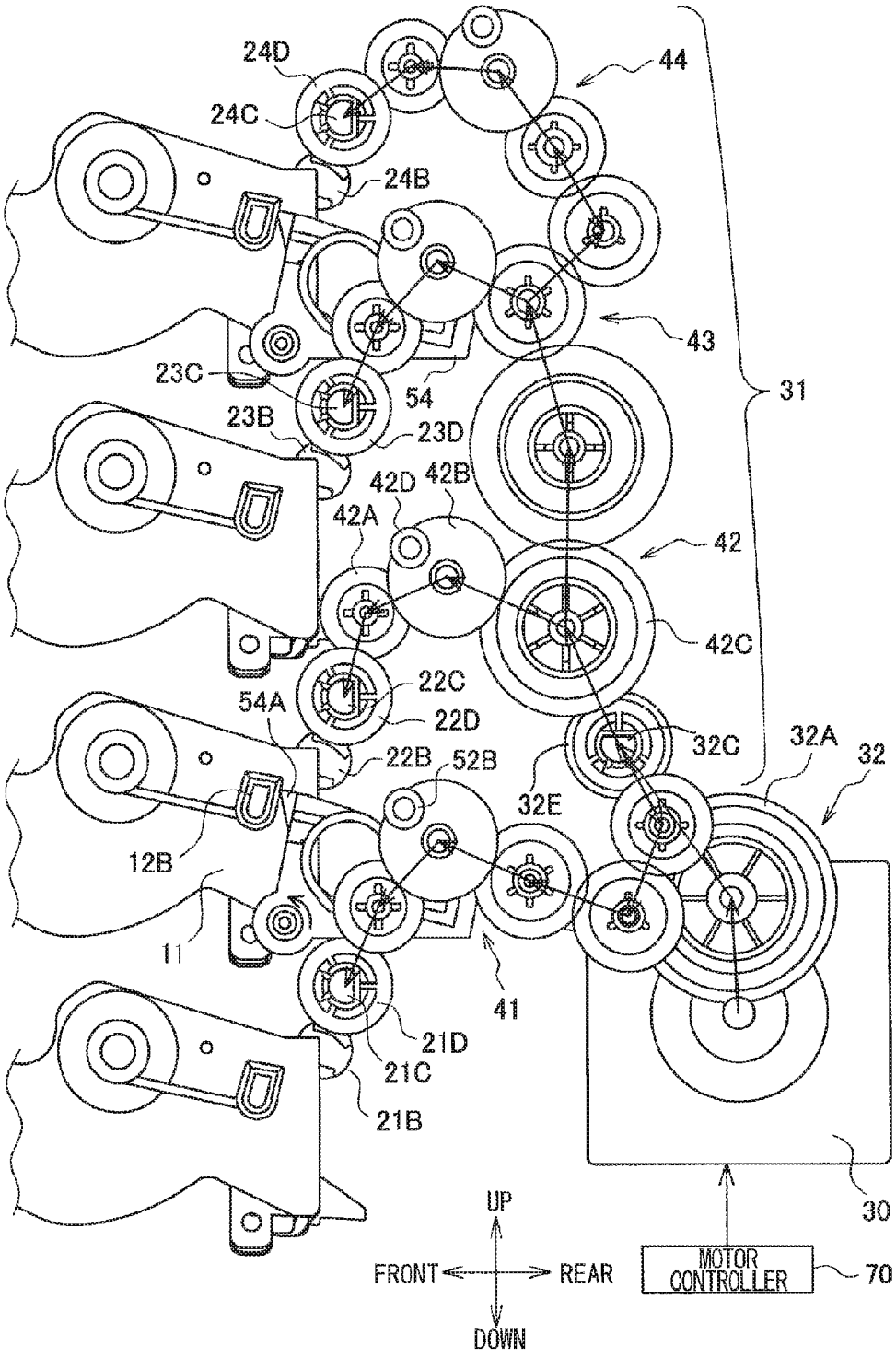
FIG. 5 is a side view of the power transmission mechanism in the sheet discharge apparatus according to the embodiment.

As shown in FIG. 5, a gear reduction mechanism 32 is provided in the left side of the support unit 15. The gear reduction mechanism 32 is configured of a gear 32A and the like. The drive force generated by the electric motor 30 is transmitted to a gear 32B on its output side (see FIG. 4) after being reduced by the gear reduction mechanism 32.

As shown in FIG. 4, the gear 32B is provided on the left longitudinal end of a shaft 32C, while a gear 32E is provided on the right longitudinal end of the shaft 32C and is engaged with gears in the gear mechanism 31. Thus, the drive force received by the gear 32B is transmitted via the shaft 32C and gear 32E to the gear mechanism 31.

The shaft 32C extends from the gear reduction mechanism 32 side to the gear mechanism 31. The shaft 32C supports a plurality of intermediate discharge rollers 32D and functions to drive the intermediate discharge rollers 32D to rotate. The intermediate discharge rollers 32D are configured to convey sheets toward the second through fourth discharge units 12A-14A.

The gear mechanism 31 is configured to distribute the drive force received via the shaft 32C and gear 32E to a gear 21D provided on the right longitudinal end of the single shaft 21C, a gear 22D provided on the right longitudinal end of the shaft 22C, a gear 23D provided on the right longitudinal end of the shaft 23C, and a gear 24D provided on the right longitudinal end of the shaft 24C.

The single shaft 21C transmits a drive force to each of the first upper rollers 21A. The shaft 22C transmits a drive force to each of the second upper rollers 22A, the shaft 23C transmits a drive force to each of the third upper rollers 23A. The shaft 24C transmits a drive force to each of the fourth upper rollers 24A.

3.2 Operation Controllers for Upper Rollers

The support unit 15 is further provided with a first operation controlling unit 41 configured to control the operations of the first upper rollers 21A, a second operation controlling unit 42 configured to control the operations of the second upper rollers 22A, a third operation controlling unit 43 configured to control the operations of the third upper rollers 23A, and a fourth operation controlling unit 44 configured to control the operations of the fourth upper rollers 24A.

The first operation controlling unit 41 and third operation controlling unit 43 have the configuration, while the second operation controlling unit 42 and fourth operation controlling unit 44 have the same configuration. Hence, a description of the first operation controlling unit 41 and second operation controlling unit 42 will be given as representative examples of the operation controllers.

3.3 Control Operations and Configuration of First Operation Controlling unit

<Overview of the First Operation Controlling unit>

The first operation controlling unit 41 controls the operations of the first upper rollers 21A, i.e., starting and stopping the rotation of the single shaft 21C (hereinafter called the first roller shaft 21C). Specifically, the first operation controlling unit 41 controls the rotation of the first roller shaft 21C in a first operating mode and. a second operating mode.

In the first operating mode, the first roller shaft 21C is placed in a halted state when the user or the like removes the second discharge tray 12 while the first roller shaft 21C and the shaft 22C (hereinafter called the second roller shaft 22C) are halted.

In the second operating mode, the first roller shaft 21C is rotated until a sheet has been completely conveyed and is subsequently placed in a halted state when the user or the like has removed the second discharge tray 12 while the first roller shaft 21C and second roller shaft 22C are rotating.

The condition of the second discharge tray 12 being removed in the above modes includes not only when the second discharge tray 12 has been completely detached from the support unit 15, but also when the second discharge tray 12 is not completely detached from the support unit 15 but is shifted out of its proper mounted position. The proper mounted position is the position in which the tray can receive a discharged sheet, such as the position shown in FIG. 1.

<Structure of First Operation Controlling Unit>

Figure 6:
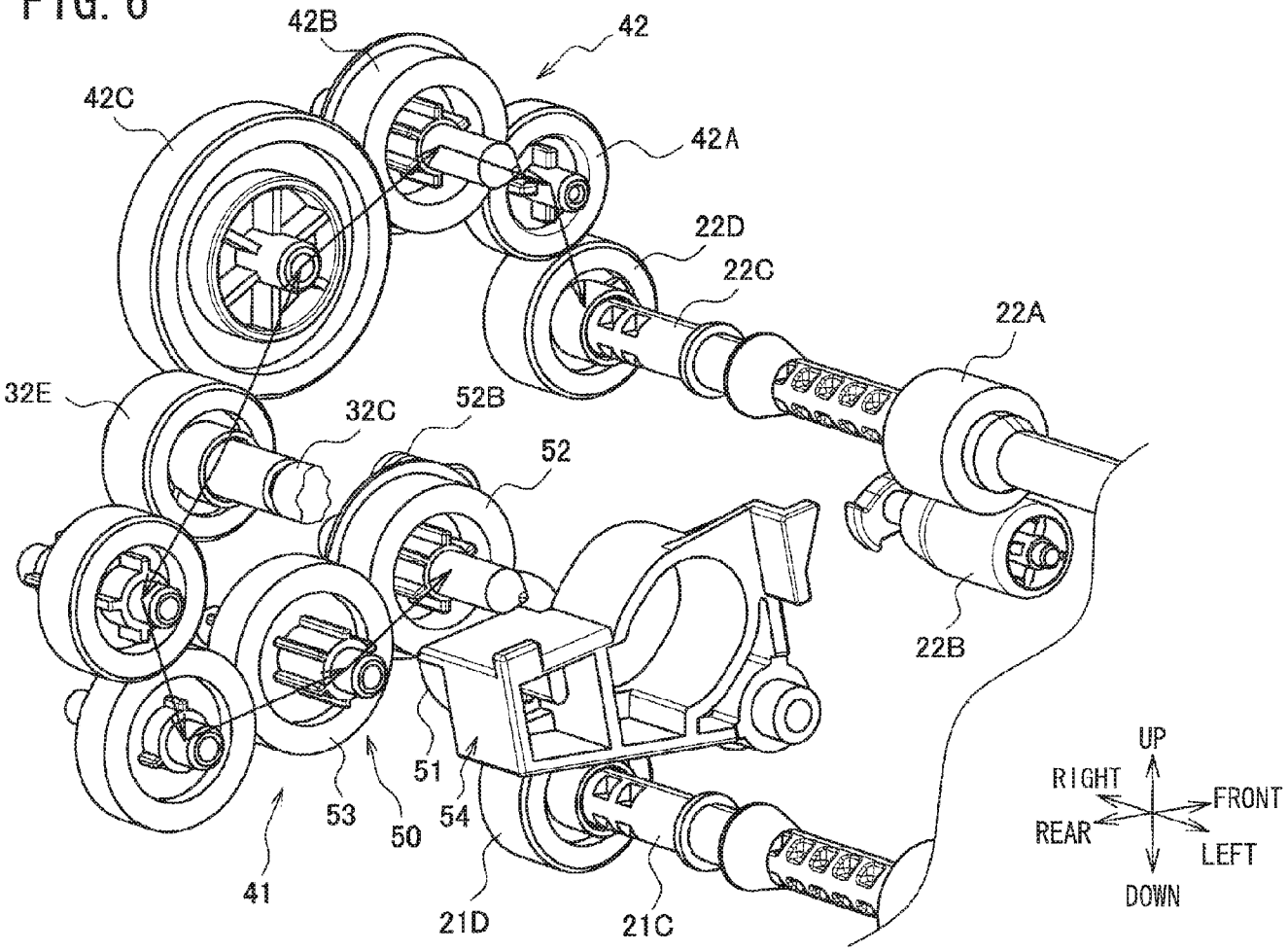
FIG. 6 is an enlarged perspective view of a part of the power transmission mechanism in the sheet discharge apparatus according to the embodiment.

The first operation controlling unit 41 has a first mechanical section 50 shown in FIG. 6, and a motor controller 70 shown in FIG. 5. The motor controller 70 is configured to control whether the electric motor 30 rotates forward or in reverse as well as its speed of rotation. In other words, the motor controller 70 controls the electric motor 30 to selectively rotate forward and in reverse to generate the drive force.

Specifically, the motor controller 70 rotates the electric motor 30 forward when conveying and discharging a sheet. After a sheet has been conveyed or discharged, the motor controller 70 rotates the electric motor 30 in reverse for a predetermined period of time and subsequently halts the rotation of the electric motor 30. When controlling the electric motor 30 during this process, the motor controller 70 rotates the electric motor 30 at a slower speed in the reverse direction than in the forward rotation.

The motor controller 70 determines Whether sheet conveyance or discharge has been completed based on a signal outputted from a sheet sensor (not shown). The sheet sensor is provided in the first discharge unit 11A, for example, for detecting the presence of a sheet.

<First Mechanical Section>

Figure 7:
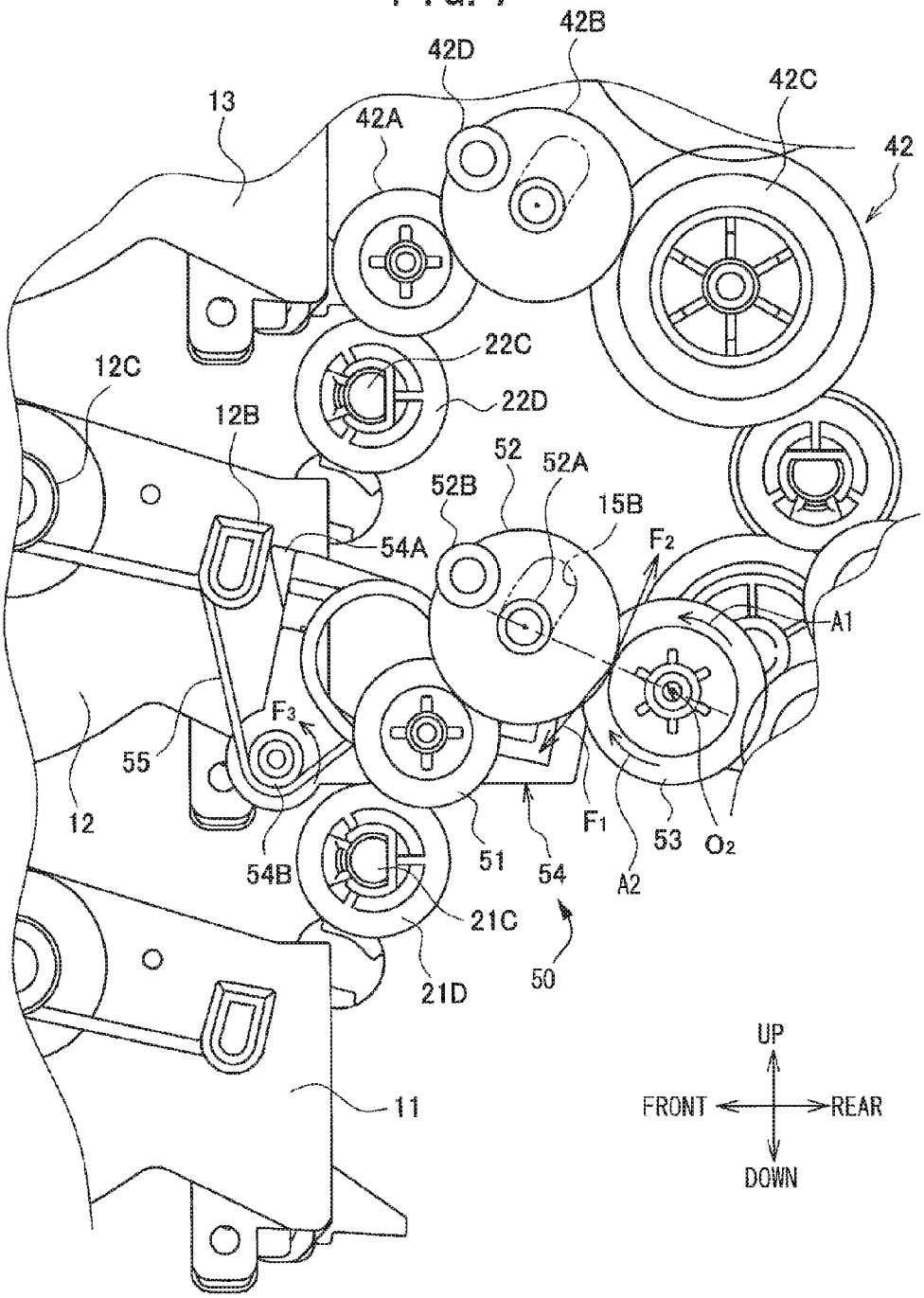
FIG. 7 is an enlarged side view of a part of the power transmission mechanism the sheet discharge apparatus according to the embodiment.

As shown in FIG. 6, the first mechanical section 50 directly controls the transmission of a drive force to the first roller shaft 21C. As shown in FIG. 7, the first mechanical section 50 includes an output gear 51, a first transmission gear 52, a second transmission gear 53, an operating member 54, and an elastic member 55.

The output gear 51 (hereinafter called the first output gear 51) is engaged with the gear 21D and transmits a drive force to the first roller shaft 21C. The first output gear 51 is engaged with the gear 211) at all times, whether the first operation controlling unit 41 is operating in the first operating mode or second operating mode.

The first transmission gear 52 transmits a drive force to the first output gear 51. The first transmission gear 52 can be displaced and movable between an engaged position shown in FIG. 7 in which the first transmission gear 52 is engaged with the first output gear 51, and a non-engaged position shown in FIGS. 10A to 11B in which the first transmission gear 52 is separated from the first output gear 51.

Figure 8:
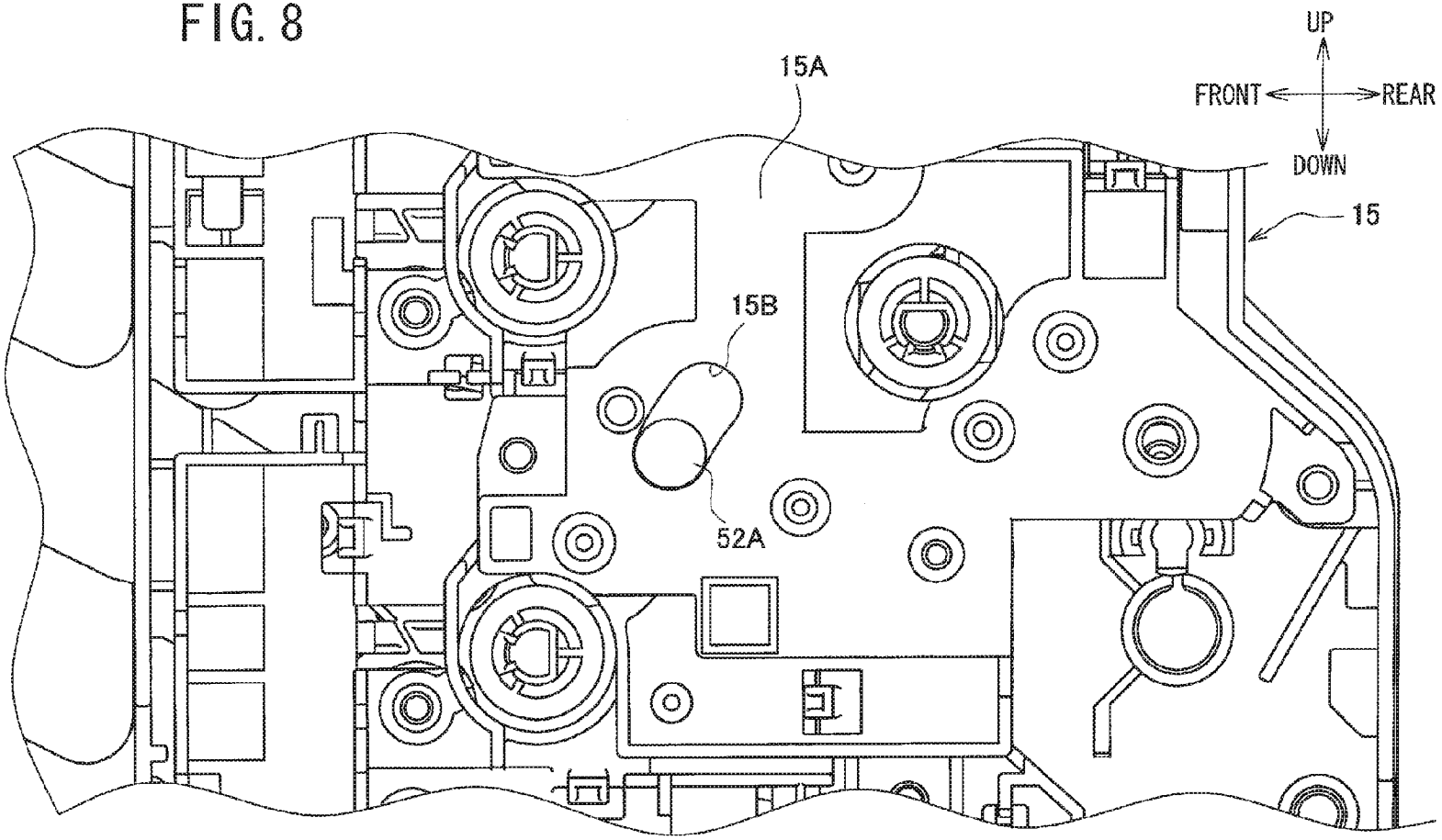
FIG. 8 is a view of a support frame and bearing part in the sheet discharge apparatus according to the embodiment.

As shown in FIG. 8, the support unit 15 has a support frame 15A for supporting the first transmission gear 52 and the like. A bearing part 15B is provided in the support frame 15A. The bearing part 15B has an elongate hole for supporting a rotational shaft 52A of the first transmission gear 52.

As shown in FIG. 7, the bearing part 15B supports the rotational shaft 52A of the first transmission gear 52 so that the rotational shaft 52A can pivot about a rotational center $O_2$ of the second transmission gear 53. Hence, the first transmission gear 52 can rotate about the rotational shaft 52A and can revolve about the rotational center $O_2$ of the second transmission gear 53. In the following description, the first transmission gear 52 will be called a first planetary gear 52.

The second transmission gear 53 is engaged with the first planetary gear 52 at all times and transmits a forward-rotation drive force or reverse-rotation drive force outputted from the electric motor 30 to the first planetary gear 52. In other words, the first planetary gear 52 rotates or revolves in association with the forward and reverse rotations of the second transmission gear 53 (hereinafter called the first sun gear 53) and stops rotating when the first sun gear 53 (the electric motor 30) stops.

Thus, when rotating in the forward direction indicated by the arrow $A_1$ in FIG. 7, the first sun gear 53 applies a meshing force $F_1$ to the first planetary gear 52. The meshing force $F_1$ (hereinafter called a proximal force $F_1$) is a force acting to displace the first planetary gear 52 by revolving the same from its non-engaged position toward its engaged position.

When rotated in the reverse direction indicated by the arrow $A_2$ in FIG. 7, the first sun gear 53 applies a meshing force $F_2$ to the first planetary gear 52. The meshing force $F_2$ is a force acting to displace the first planetary gear 52 by revolving the first planetary gear 52 from its engaged position toward its non-engaged position.

The meshing forces $F_1$ and $F_2$ when the first planetary gear 52 is in the non-engaged position are the engagement pressure generated by the first sun gear 53 engaging with the first planetary gear 52. Therefore, the meshing forces $F_1$ and $F_2$ are oriented along the direction of the angle of pressure generated in the engaging parts of the first sun gear 53 and first planetary gear 52, i.e., the direction in which the engaging part of the first sun gear 53 advances along the rotating direction of the first sun gear 53.

Figure 9A:
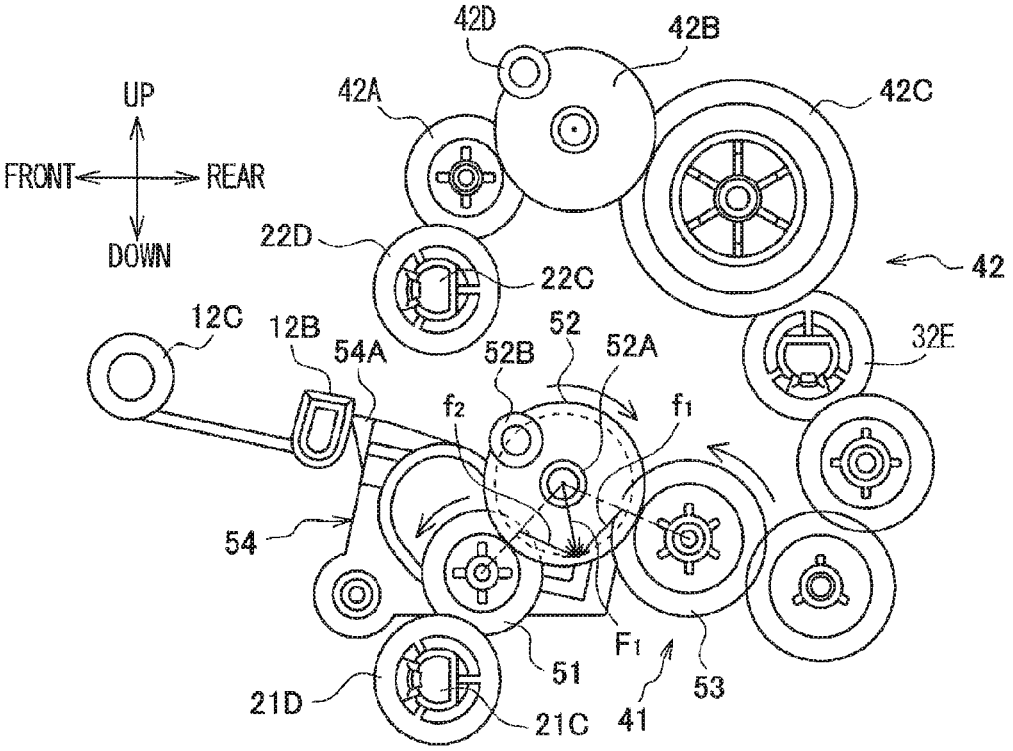
FIGS. 9A and 9B show a part of the power transmission mechanism in a first state of the sheet discharge apparatus according to the embodiment.

The proximal force $F_1$ when the first planetary gear 52 is in the engaged position is the sum of an engagement pressure $f_1$ and an engagement pressure $f_2$ shown in FIG. 9A. The engagement pressure $f_1$ is the pressure generated by the engagement of the first sun gear 53 and first planetary gear 52. The engagement pressure $f_2$ is the pressure generated by the engagement of the first planetary gear 52 and first output gear 51. Hence, the proximal force $F_1$ when the first planetary gear 52 is in the non-engaged position is a different force (vector) from the proximal force $F_1$ when the first planetary gear 52 is in the engaged position (FIG. 7).

The first mechanical section 50 also includes a resistive body 52B shown in FIG. 7 that applies a force of resistance to the first planetary gear 52 for preventing rotation of the same. The resistive body 52B is a spring or other elastic member disposed between the support frame 15A and a side surface of the first planetary gear 52 for exerting the resistive force described above.

When the first planetary gear 52 is in a state in which it can be displaced by revolving (hereinafter called the revolvable state), the meshing forces $F_1$ and $F_2$ are forces for displacing the first planetary gear 52 by revolving the first planetary gear 52 in the direction of the meshing forces $F_1$ and $F_2$ (hereinafter called the revolving forces).

When the first planetary gear 52 is in the state in which it cannot be displaced by revolving (hereinafter called the non-revolvable state), the meshing threes $F_1$ and $F_2$ are forces for rotating the first planetary gear 52 in the direction of the meshing forces $F_1$ and $F_2$ (hereinafter called rotating forces)

When the first planetary gear 52 is in its engaged position, i.e., when the rotational shaft 52A of the first planetary gear 52 is positioned in the lower longitudinal end of the bearing part 15B, the first planetary gear 52 is in its non-revolvable state and cannot be displaced further toward the first output gear 51.

Therefore, if the first sun gear 53 rotates forward While the first planetary gear 52 is in the engaged position, the proximal force $F_1$ functions as a rotating force for rotating the first planetary gear 52. Thus, if the first sun gear 53 rotates forward while the first planetary gear 52 is in the engaged position, the drive force is transmitted to the first output gear 51 via the first planetary gear 52.

When in the engaged position, the first planetary gear 52 is in a revolvable state for being displaced toward the non-engaged position. Accordingly, if the first sun gear 53 is rotated in reverse, the meshing force $F_2$ functions as a revolving force for displacing the rotational shaft 52A toward the upper longitudinal end of the bearing part 15B.

Further, when the first planetary gear 52 is in the non-engaged position, the first planetary gear 52 is in its revolvable state and, thus, can be displaced toward the engaged position. Accordingly, if the first sun gear 53 rotates in the forward direction, the proximal force $F_1$ functions as a revolving force for displacing the rotational shaft 52A toward the lower longitudinal end of the bearing part 15B.

The operating member 54 can be displaced between a contact position and a separated position. In the contact position shown in FIG. 11B, the first planetary gear 52 (the rotational shaft 52A in the embodiment) is in contact with the operating member 54. In the separated position shown in FIGS. 9B and 10B, the operating member 54 is separated from the first planetary gear 52 (the rotational shaft 52A).

The operating member 54 is disposed in the contact position when at least the second discharge tray 12 is detached from the support unit 15. In the embodiment, the operating member 54 is a lever-type member that is pivotably mounted on the support frame 15A.

More specifically, the second discharge tray 12 is provided with a contact part 12B that contacts a contact-receiving part 54A provided on the operating member 54, as shown in FIG. 7. When the second discharge tray 12 is attached to the support unit 15, the contact part 12B contacts the contact-receiving part 54A and moves the operating member 54 to the separated position.

The second discharge tray 12 is also provided with an anchoring protrusion 12C for anchoring the second discharge tray 12 to the support unit 15. The contact part 12B is provided on a portion of the second discharge tray 12 offset from the anchoring protrusion 12C toward the operating member 54 side.

The elastic member 55 is configured to exert an elastic force (hereinafter called a separating force $F_3$) on the first planetary gear 52 for displacing the first planetary gear 52 toward the non-engaged position. The separating force $F_3$ acts on the first planetary gear 52 through the operating member 54.

The separating force $F_3$ does not act on the first planetary gear 52 when the first planetary gear 52 is in the non-engaged position, but is applied to the first planetary gear 52 when the first planetary gear 52 is in the engaged position. The elastic member 55 according to the embodiment is configured of a torsion coil spring whose coil segment is positioned on a pivoting shaft 54B of the operating member 54.

The separating force $F_3$ applied by the elastic member 55 is set such that the proximal force F is greater than the separating force $F_3$ when the first planetary gear 52 is in the engaged position and less than the separating force $F_3$ when the first planetary gear 52 is in the non-engaged position.

Here, the magnitudes of the proximal force $F_1$ and separating force $F_3$ described above are compared based on the magnitudes of the proximal force $F_1$ and separating force $F_3$ applied to the first upper roller 21A of the first planetary gear 52. In other words, the magnitudes of the proximal force $F_1$ and separating force $F_3$ are taken when the initial point of the vector indicating the proximal force $F_1$ and the initial point of the vector indicating the separating force $F_3$ are aligned with the center of the rotational shaft 52A.

3.4 Control Operations and Configuration of Second Operation Controlling Unit

The second operation controlling unit 42 has a similar configuration to the first operation controlling unit 41 minus the operating member 54 and elastic member 55. Specifically, the second operation controlling unit 42 includes a second output gear 42A, a second planetary gear 42B, a second sun gear 42C, and a resistive body 42D, as shown in FIG. 7.

The second output gear 42A is equivalent to the first output gear 51 of the first operation controlling unit 41 and functions to transmit a drive force to the second roller shaft 22C (the second upper rollers 22A). The second sun gear 42C is equivalent to the first sun gear 53 of the first operation controlling unit 41 and rotates upon receiving a forward-rotation drive force or reverse-rotation drive force from the electric motor 30.

The second planetary gear 42B is equivalent to the first planetary gear 52 in the first operation controlling unit 41 and incurs a resistive force from the resistive body 42D. The second planetary gear 42B is constantly engaged with the second sun gear 42C and rotates or revolves upon receiving a forward-rotation or reverse-rotation drive force from the second sun gear 42C.

3.5 Detailed Operations of First and Second Operation Controlling Units

Figure 9B:
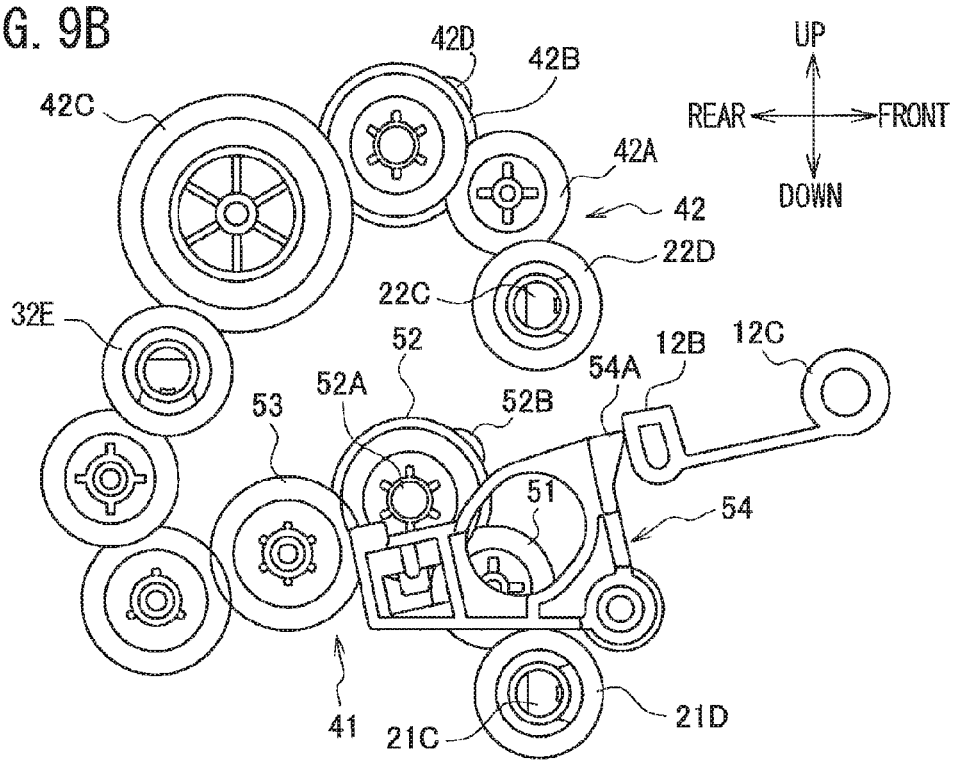

FIGS. 9A and 9B show the state of the sheet discharge apparatus 10 when the electric motor 30 is rotating forward while the second discharge tray 12 is mounted in the support unit 15 (hereinafter the first state).

In the first state, the first planetary gear 52 and second planetary gear 42B are in their engaged positions described above. Accordingly, the first roller shaft 21C and second roller shaft 22C (i.e., the first upper rollers 21A and second upper rollers 22A) rotate in a direction for discharging sheets.

Figure 10A:
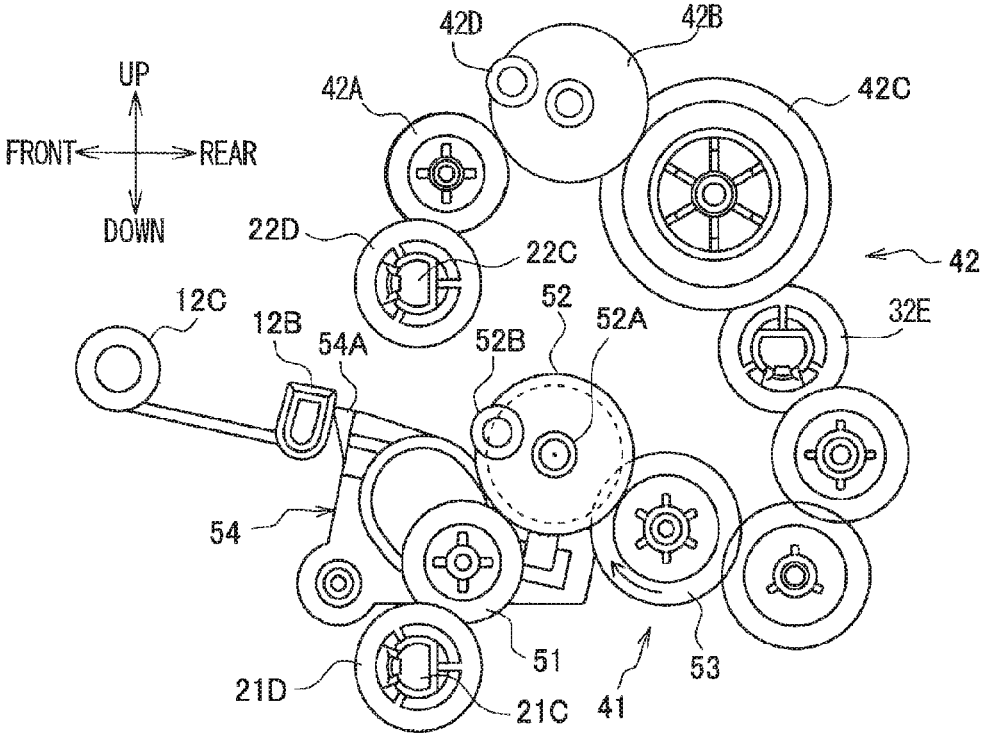
FIGS. 10A and 10B show the part of the power transmission mechanism in a second state of the sheet discharge apparatus according to the embodiment.
Figure 10B:
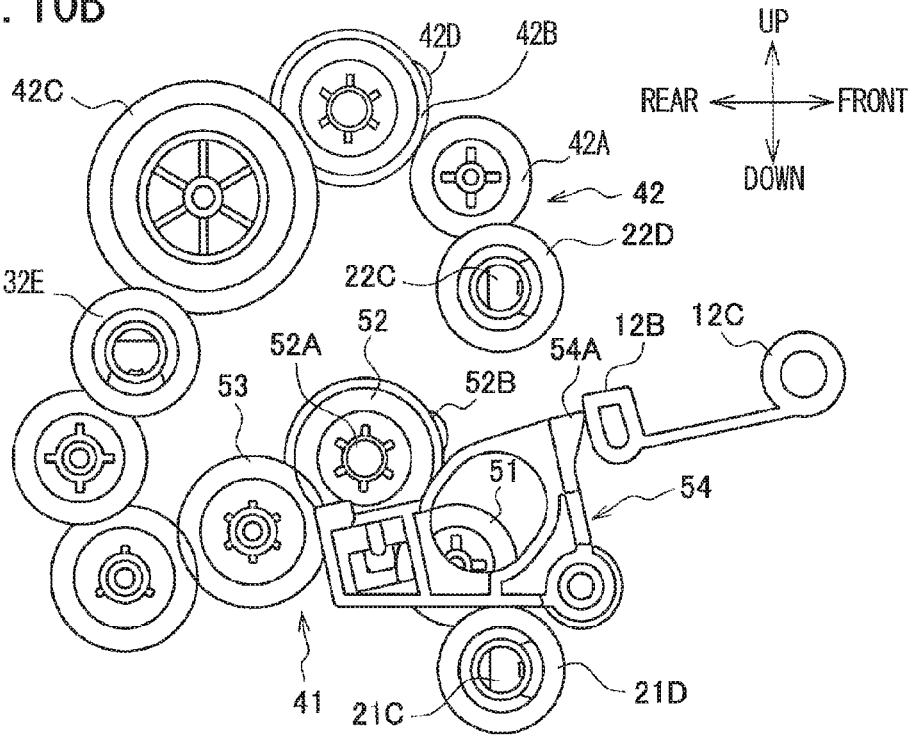

FIGS. 10A and 10B show the state of the sheet discharge apparatus 10 when the electric motor 30 is rotated in reverse while the second discharge tray 12 is mounted in the support unit 15 (hereinafter called the second state). More specifically, the sheet discharge apparatus 10 enters the second state when the electric motor 30 is rotated in reverse after the sheet discharge apparatus 10 has been in the first state. At this time, the motor controller 70 controls the rotational speed for the reverse rotation to be slower than that used for forward rotation.

In the second state, the first planetary gear 52 and the second planetary gear 42B are placed in their non-engaged positions by the meshing force $F_2$ described above. Since the transmission paths for the drive force to the first roller shaft 21C and second roller shaft 22C is interrupted when the first planetary gear 52 and second planetary gear 42B are in their non-engaged positions, the first upper rollers 21A and second upper rollers 22A are in a halted state.

Figure 11A:
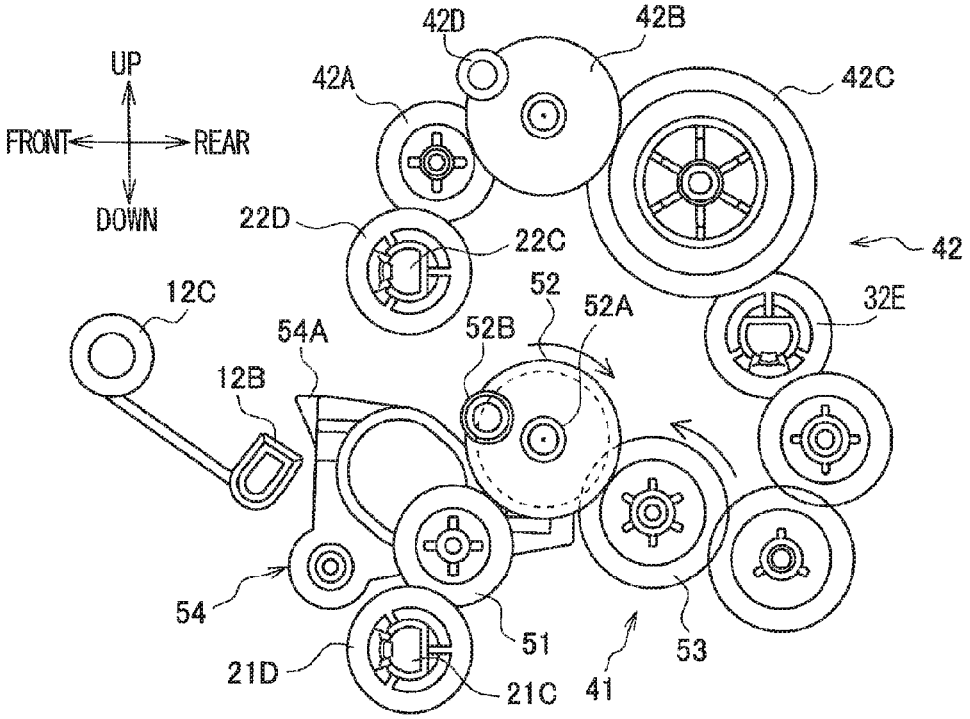
FIGS. 11A and 11B show the part of the power transmission mechanism in a third state of the sheet discharge apparatus according to the embodiment.
Figure 11B:
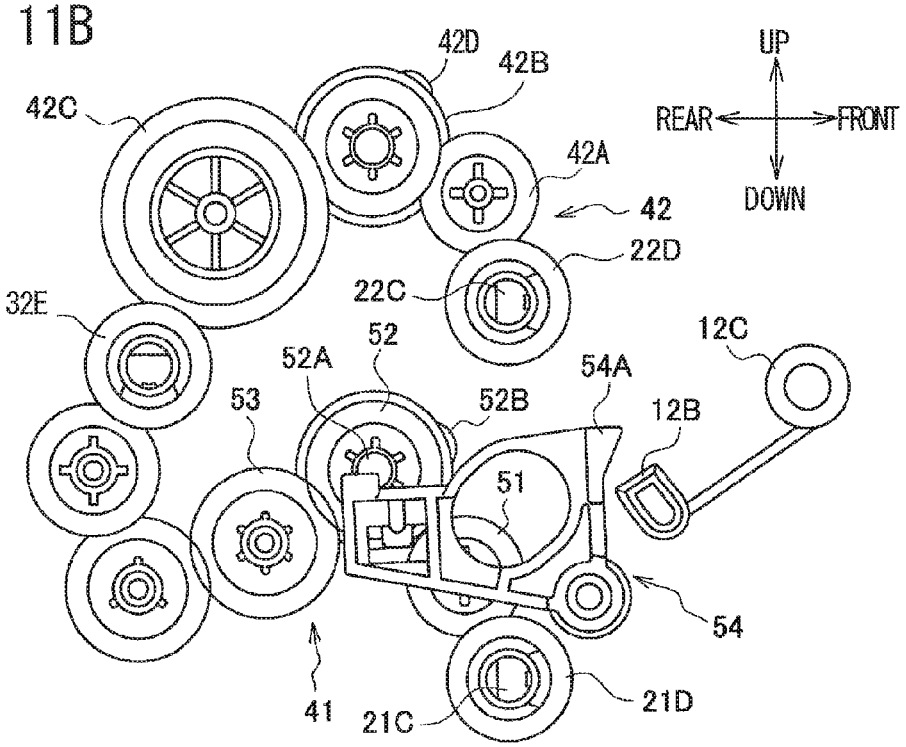

FIGS. 11A and 11B show the state of the sheet discharge apparatus 10 when the second discharge tray 12 is detached from the first mechanical section 50 while the first planetary gear 52 and second planetary gear 42B are in their non-engaged positions, and the electric motor 30 is subsequently rotated forward (hereinafter called the third state).

In the third state, the second planetary gear 42B is revolved from its non-engaged position to its engaged position and subsequently rotated in the engaged position by the proximal force $F_1$ applied thereto. As a result, a drive force is transmitted to the second roller shaft 22C for rotating the second upper rollers 22A.

Since the proximal force $F_1$ when the first planetary gear 52 is in the non-engaged position is smaller than the separating force $F_3$ in the third state, the first planetary gear 52 cannot be revolved to its engaged position. Accordingly, transmission of the drive force to the second roller shaft 22C remains interrupted, and the first upper rollers 21A remain in a halted state.

Figure 12A:
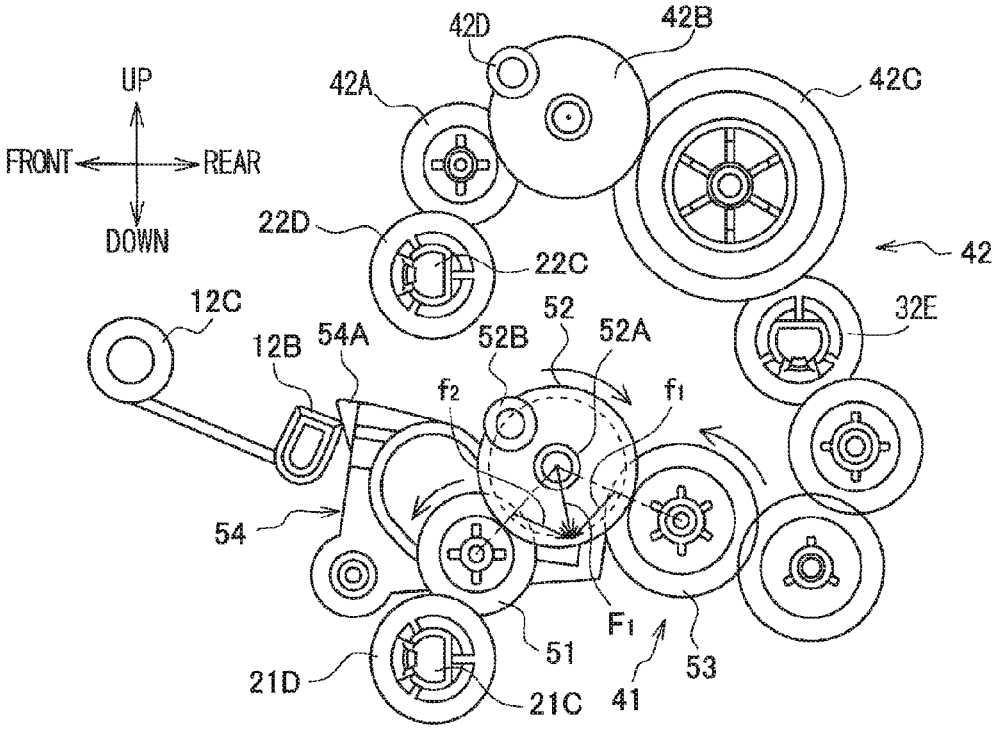
FIGS. 12A and 12B show the part of the power transmission mechanism in a fourth state of the sheet discharge apparatus according to the embodiment.
Figure 12B:
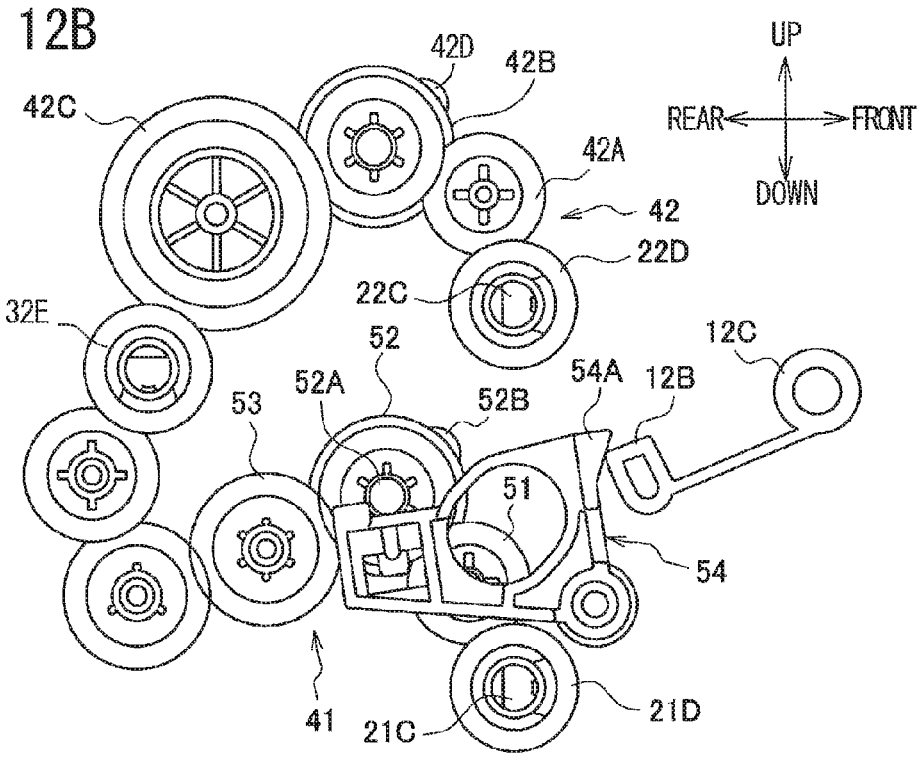

FIGS. 12A and 12B show the state of the sheet discharge apparatus 10 after the second discharge tray 12 has been detached from the support unit 15 (including cases in which the second discharge tray 12 is shifted from its proper mounted position) while a forward-rotation drive force is being transmitted to the first roller shaft 21C and second roller shaft 22C (hereinafter called the fourth state).

Since the proximal force $F_1$ when the first planetary gear 52 is in the engaged position is greater than the separating force $F_3$ in the fourth state, the first planetary gear 52 is maintained in its engaged position. Therefore, the first roller shaft 21C and second roller shaft 22C, i.e., the first upper rollers 21A and second upper rollers 22A, rotate in a direction for discharging sheets.

After the sheet is discharged, the electric motor 30 is then rotated in reverse so that the sheet discharge apparatus 10 is in the same state as the second state described above. Hence, the transmission paths for the drive force to the first roller shaft 21C and second roller shaft 22C are interrupted.

4. Features of Image Forming Apparatus according to Embodiment (and in Particular, the Sheet Discharge Apparatus)

The sheet discharge apparatus 10 according to the embodiment described above has a first operating mode and a second operating mode, In the first operating mode, the first upper rollers 21A are placed in a halted state when the second discharge tray 12 is removed while the first roller shaft 21C and second roller shaft 22C are not rotating. In the second operating mode, the first upper rollers 21A are rotated until a sheet has been completely conveyed and are subsequently brought to a halt, when the second discharge tray 12 is removed while the first roller shaft 21C and second roller shaft 22C are rotating.

Thus, the first upper rollers 21A are placed in a halted state in the embodiment if the second discharge tray 12 is detached from the support unit 15 (the stacker mode) before sheet conveyance has begun. Accordingly, the sheet discharge apparatus according to the embodiment generates less noise in the stacker mode than a sheet discharge apparatus that continues to rotate all discharge rollers.

If the user were to inadvertently remove the second discharge tray 12 while a sheet is being discharged in the normal mode (i.e., while the first upper rollers 21A are still rotating when the sheet discharge apparatus is not in the stacker mode) and rotation of the first upper rollers 21A were to be halted at the same time the second discharge tray 12 was removed from the support unit 15, the sheet being discharged would jam and the discharge operation would be unsuccessful.

However, in the embodiment, the first upper rollers 21A are allowed to continue rotating when the second discharge tray 12 is detached from the support unit 15 after sheet conveyance has begun until the sheet conveyance is completed, and are subsequently placed in a halted state. Hence, the sheet discharge apparatus 10 according to the embodiment suppresses the occurrence of sheet discharge problems.

In the embodiment described above, the operating member 54 is placed in the separated position when the second discharge tray 12 is mounted in the support unit 15 and, hence, is not in contact with the first planetary gear 52 during the normal mode. This arrangement not only can reduce premature wear in the first planetary gear 52 and operating member 54, but also can reduce noise generated by contact between the first planetary gear 52 and operating member 54.

Variations

While the first operation controlling unit 41 in the embodiment described above includes the first mechanical section 50, motor controller 70, and the like, the first operation controlling unit 41 is not limited to this configuration. For example, the first operation controlling unit 41 may be provided with separate drive motors for driving the first roller shaft 21C and the second roller shaft 22C and may control the drive motors independently. Alternatively, the first operation controlling unit 41 may be provided with a drive interrupting mechanism, such as an electromagnetic clutch, in place of the first planetary gear 52 and may directly control the drive interrupting mechanism.

While the description has been made in detail with reference to the specific embodiment thereof, it would be apparent to those skilled in the art that various changes and modifications may be made therein without departing from the spirit and scope of the above described embodiment.

What is claimed is:

1. A sheet discharge apparatus comprising:

a first discharge tray;

a second discharge tray disposed above the first discharge tray;

a support unit configured to support the first discharge tray and the second discharge tray, the second discharge tray being attachable to and detachable from the support unit;

an electric motor configured to generate a drive force;

a first discharge roller configured to be driven by the drive force and configured to discharge a sheet toward the first discharge tray;

a second discharge roller configured to be driven by the drive force and configured to discharge a sheet toward the second discharge tray;

a first controlling unit configured to:

control, in a case that the second discharge tray is detached from the support unit while the first discharge roller and the second discharge roller are halted, the first discharge roller to remain halted; and control, in a case that the second discharge tray is detached from the support unit while the first discharge roller and the second discharge roller are rotating, the first discharge roller to be halted after the first discharge roller continues rotating until a sheet has been discharged toward the first discharge tray; and a second controlling unit configured to control the second discharge roller.

2. The sheet discharge apparatus according to claim 1, wherein the first controlling unit is configured to control the first discharge roller to be halted by interrupting transmission of the drive force from the electric motor to the first discharge roller.

3. The sheet discharge apparatus according to claim 1, wherein the first controlling unit comprises:

an output gear configured to transmit the drive force to the first discharge roller;

a first transmission gear movable between an engaged position and a non-engaged position, in the engaged position the first transmission gear being engaged with the output gear to transmit the drive force to the output gear, and in the non-engaged position the first transmission gear being separated from the output gear, the first transmission gear being configured to rotate forward and in reverse, a first force acting to displace the first transmission gear from the non-engaged position toward the engaged position while the first transmission gear is rotating forward, and a second force acting to displace the first transmission gear from the engaged position toward the non-engaged position while the first transmission gear is rotating in reverse;

an operating member movable between a contact position and a separated position, in the contact position the operating member being in contact with the first transmission gear, in the separated position the operating member being separated from the first transmission gear, the operating member being disposed in the contact position when the second discharge tray is detachable from the support unit; and an elastic member configured to exert, on the first transmission gear through the operating member, a separating force for displacing the first transmission gear toward the non-engaged position.

4. The sheet discharge apparatus according to claim 3, wherein the first transmission gear has a rotational shaft, wherein the sheet discharge apparatus further comprises:

a second transmission gear rotatable about a rotational center and engaged with the first transmission gear to transmit the drive force to the first transmission gear; and a bearing part configured to support the rotational shaft such that the rotational shaft of the first transmission gear is pivotable about the rotational center of the second transmission gear, wherein the first force when the first transmission gear is disposed at the engaged position is greater than the separating force of the elastic member, and wherein the first force when the first transmission gear is disposed at the non-engaged position is smaller than the separating force of the elastic member.

5. The sheet discharge apparatus according to claim 4, further comprising a motor controller configured to control the electric motor to selectively rotate forward and in reverse to generate the drive force, the drive force causing the second transmission gear to rotate.

6. The sheet discharge apparatus according to claim 5, wherein the motor controller controls, when the first transmission gear is rotating in reverse, the electric motor to rotate at a rotational speed slower than a rotational speed of the electric motor when the first transmission gear is rotating forward.

7. The sheet discharge apparatus according to claim 3, wherein the second discharge tray has a contact part, and wherein the operating member has a contacted portion configured to be in contact with the contact part when the second discharge tray is attached to the support unit, contact of the contacted portion with the contact part causing the operating member to move toward the separated position.

* * * * *